United States Patent [19]

Stewart

[11] Patent Number: 5,071,000

[45] Date of Patent: Dec. 10, 1991

[54] JEWELRY DISPLAY APPARATUS

[76] Inventor: Jessamine Stewart, 649 Lemon Hill Ter., Fullerton, Calif. 92632

[21] Appl. No.: 665,249

[22] Filed: Mar. 6, 1991

[51] Int. Cl.[5] ..... A45C 11/16; B65D 5/52

[52] U.S. Cl. ..... 206/45.14; 206/45.24; 206/6.1; 206/566; 206/495

[58] Field of Search ..... 206/45.14, 45.24, 6.1, 206/566, 495

[56] References Cited

U.S. PATENT DOCUMENTS

| | | | |
|---|---|---|---|
| 658,488 | 9/1900 | Levy . | |
| 712,808 | 11/1902 | Kaffeman . | |
| 4,099,611 | 7/1978 | Feibelman | 206/566 X |
| 4,181,224 | 1/1980 | Aber | 206/566 X |
| 4,223,783 | 9/1980 | Marshall | 206/45.14 |
| 4,371,077 | 2/1983 | Solitt et al. | 206/566 X |
| 4,413,736 | 11/1983 | Nibling | 206/566 |
| 4,420,084 | 12/1983 | Whelan | 206/566 |
| 4,687,103 | 8/1987 | Corbett | 206/566 |
| 4,767,011 | 8/1988 | Butler | 206/566 X |
| 4,787,516 | 11/1988 | Morrison | 206/566 |
| 4,821,883 | 4/1989 | Miller | 206/566 X |
| 4,848,585 | 7/1989 | Snyder | 206/566 |
| 4,905,821 | 3/1990 | Corbett | 206/566 X |
| 4,923,069 | 5/1990 | Germain et al. | 206/566 X |
| 5,025,918 | 6/1991 | Bergeron | 206/45.14 |

*Primary Examiner*—William I. Price

*Attorney, Agent, or Firm*—Frank J. Uxa, Jr.

[57] ABSTRACT

An apparatus for displaying or storing jewelry of the type having at least one pin-like shaft, such as pierced earrings, comprises a frame having two frame support members and at least one frame spacer member. A fabric panel is stretched across the frame, the fabric being directly attached to the support member but not the spacer member or members. To display or store the jewelry, the pin-like shaft is inserted through the fabric panel. The frame can be quickly disassembled by detaching the frame spacer member or members from the frame support members. Once the frame is disassembled, the fabric panel may be scrolled about the frame support members to create a compact package for easy transportability or storage.

20 Claims, 2 Drawing Sheets

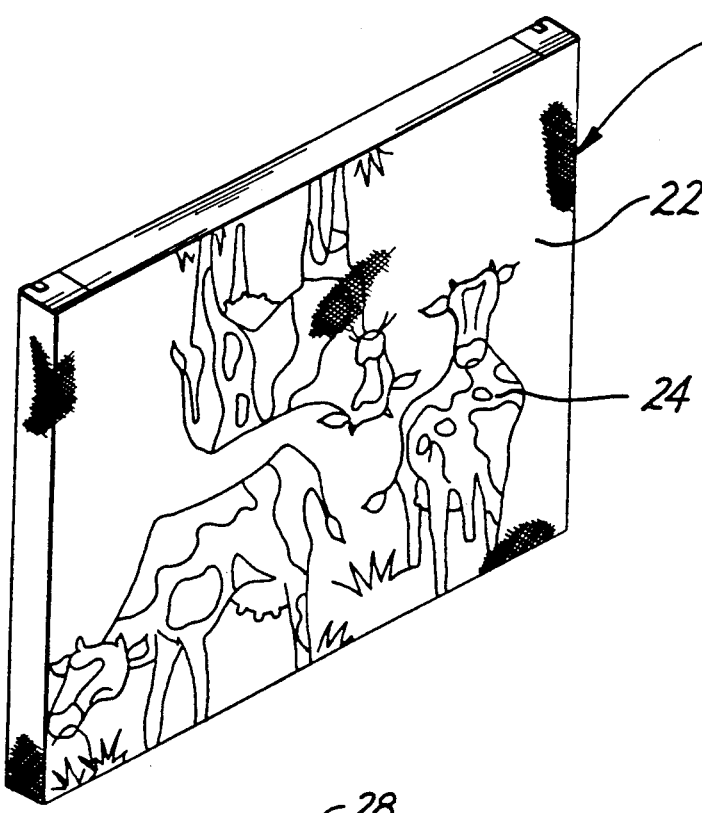
Fig. 1
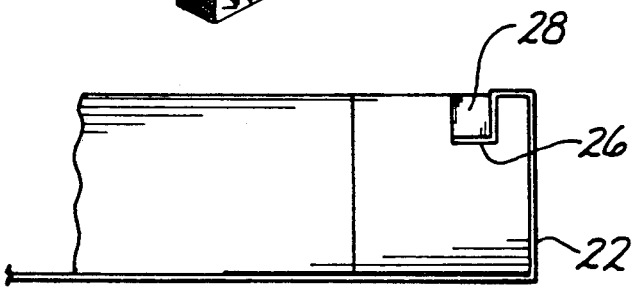
Fig. 2
Fig. 3
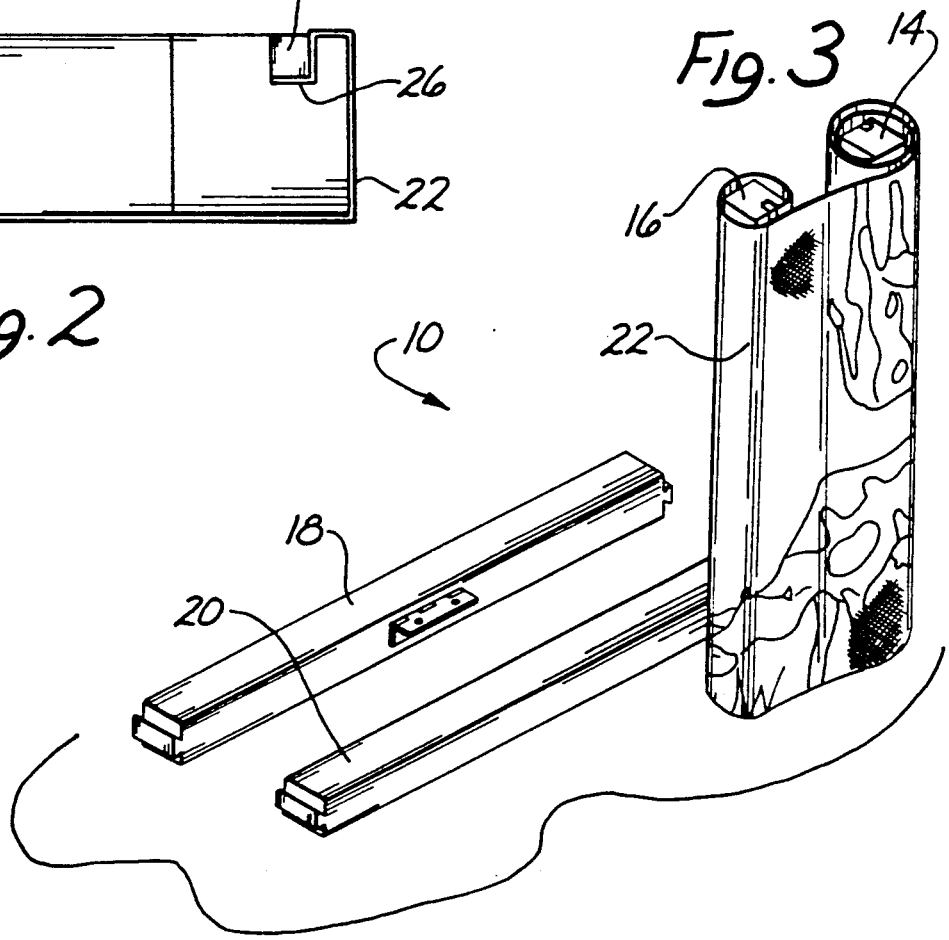

JEWELRY DISPLAY APPARATUS

BACKGROUND OF THE INVENTION

1. Technical Field

This invention relates generally to jewelry display or storage devices, and more particularly to a new jewelry display or storage apparatus which is easily assembled and disassembled so that it can be conveniently transported or stored when not in use.

2. Background Information

There is a great demand for devices which can store or display jewelry in an organized and attractive manner. Earrings, in particular, are difficult to display or store because of their small size and odd shapes, and the fact that they are used in pairs. In the home, earrings are typically stored in jewelry boxes where they become jumbled and are frequently lost. In the retail setting, earrings are displayed both in stores and, increasingly today, at home demonstration parties, swap meets, or craft fairs. The earrings are typically displayed on small cards or boxes, but are not readily detachable. The display is bland and unimaginative, and it is difficult to transport large numbers of earrings because of the many small cards and boxes involved. Furthermore, one or more of the small cards and boxes can be easily lost.

A type of apparatus has been developed in response to the demand for a device which can both display and store earrings in an attractive eye-catching manner, from which the earrings can be easily detached, and which is easily transported. This prior art apparatus comprises a frame to which a panel of fabric has been attached to all points around the frame. The panel of fabric stretches across the frame. Earrings or other jewelry having a pin-like shaft can be displayed on the fabric panel by placing the pin-like shaft through the fabric. As a result, the earrings are displayed in a more eye-catching manner, are easily attachable and detachable, and can be transported from one location to another merely by carrying the assembled frame, rather than having to pack up the earrings themselves.

A problem with this is that the frame itself is quite bulky and awkward, making it difficult to transport. Many of these devices actually comprise an inner frame, to which the fabric is attached, which is then inserted into an outer frame. When disassembled, this requires the portage of two bulky frames for each display device to be removed. What is needed is a display device which can be quickly and easily disassembled to form a very compact package that can be readily transported, yet does not require removal of the earrings from the fabric panel. In other words, the earrings should be safely storable in the device even in its disassembled state.

SUMMARY OF THE INVENTION

This invention solves the problems outlined above. With this invention, a display device for jewelry and the like may be readily disassembled and reassembled so that it is easily and compactly transportable, without having to remove the jewelry from its display position.

The device of this invention comprises an apparatus for displaying or storing objects having at least one pin-like shaft. The apparatus includes a fabric panel through which pin-like shafts of the objects may be placed. A first end of the fabric panel is attached to a first frame support element. A second, preferably opposite, end of the fabric is attached to a second frame support element. At least one frame spacer element is positioned between the first and second frame support elements to space them apart. Importantly, the fabric panel is not directly attached to the frame spacer element or elements.

A tongue and groove arrangement of a type well known in the art is preferably used to attach the frame spacer element or elements to the frame support elements. Each end of each frame spacer element has a tongue or groove, preferably a tongue, thereon which is engaged with a corresponding groove or tongue, preferably a groove, on a frame support element, in such a manner as to create an interference fit. Consequently, one is able to quickly attach and detach each frame spacer element to both frame support elements. Preferably, two frame spacer elements are joined to the two frame support elements, more preferably to create a generally rectangular frame.

This invention is particularly useful for displaying or storing earrings of the type used in pierced ears, having a straight pin-like shaft and a back which is capped onto the end of the shaft after is passes through the ear. To display or store the earring, the pin-like shaft is placed through the front side of the fabric panel and the back is capped onto the shaft on the rear side of the fabric panel. Thus, the earring is thereby secured to the fabric panel. Preferably, the fabric panel includes ornamental decorations, for example, which are printed onto the fabric panel. The jewelry can be arranged to complement the decorations in order to create an aesthetically pleasing display medium for the jewelry.

The apparatus is preferably mounted to a wall or stand using a hinge, which is positioned on one of the frame support or spacer elements, preferably on one of the frame spacer elements, and which allows the apparatus to swing out from the wall or stand while remaining mounted. When swung out on the hinge, the back of the fabric is readily accessible for placing jewelry into or removing jewelry from the fabric.

A major aspect of the invention is the ready detachability of the frame spacer elements from the frame support elements for easy storage and portability. After disassembly, the frame support elements preferably can be rotated toward each other, thereby scrolling the fabric around the frame support elements. The result is a very compact package for storage and transport, while yet allowing the jewelry to remain attached to the fabric panel. Even without the objects attached to the fabric panel, the quick and easy assembly/disassembly feature allows the present system to be compactly and attractively packaged for sale. Assembly can be accomplished very quickly, with little or no need for assembly tools or expertise.

BRIEF DESCRIPTION OF THE DRAWINGS

FIG. 1 of the drawings is a perspective view of the front side of a jewelry display apparatus including a frame assembly constructed according to the invention.

FIG. 2 is an enlarged plan view of one corner of the frame assembly, showing the attachment of a fabric panel to a frame support member.

FIG. 3 is a perspective view of the display apparatus showing the frame in its disassembled state with the fabric panel scrolled around two frame support members.

DETAILED DESCRIPTION OF THE DRAWING

Figure 4:
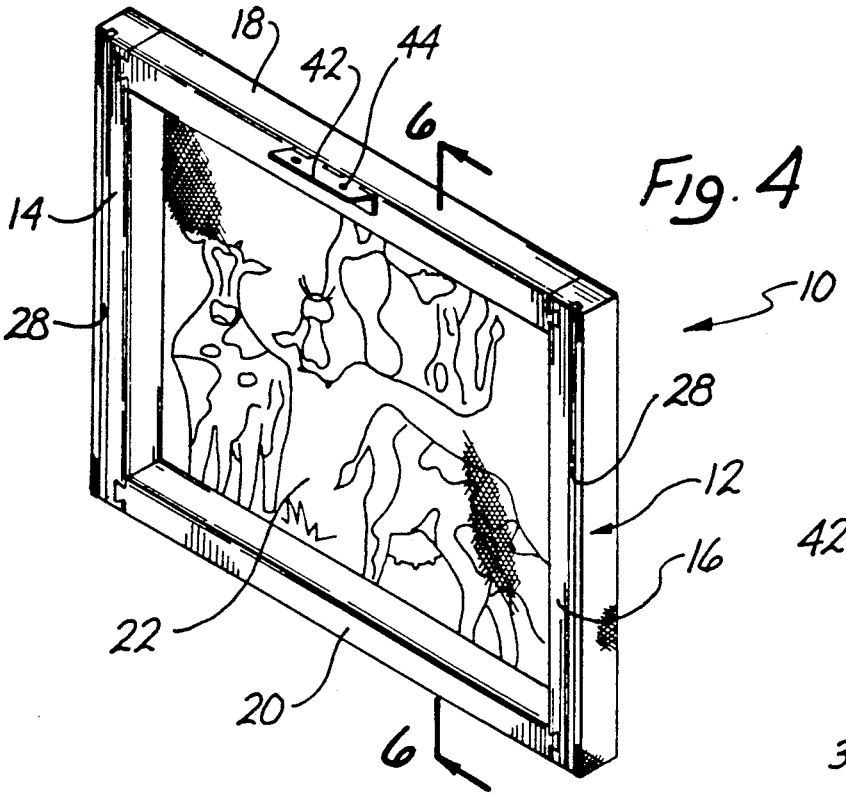
FIG. 4 is a perspective view of the rear side of a jewelry display apparatus constructed according to the invention.

Referring now to FIGS. 1 and 4, there is shown a jewelry display or storage apparatus 10 constructed according to the invention. The apparatus comprises a four-sided frame 12, the frame being composed of two frame support members 14, 16 and two frame spacer members 18, 20. Over this frame a fabric panel 22 is stretched, the two opposite ends of the fabric panel being attached to each of the two frame support members. The fabric panel 22 preferably has printed on it an ornamental decoration 24. The four frame members are preferably made of wood, though any other known material could be used, such as plastic or metal. Also, although two frame spacer members are shown, one or more may be employed. Of course, the ornamental decoration could comprise anything at all, depending upon the tastes of the user. In the preferred embodiment shown in the drawings, the ornamental decoration comprises a plurality of cows.

Figure 5:
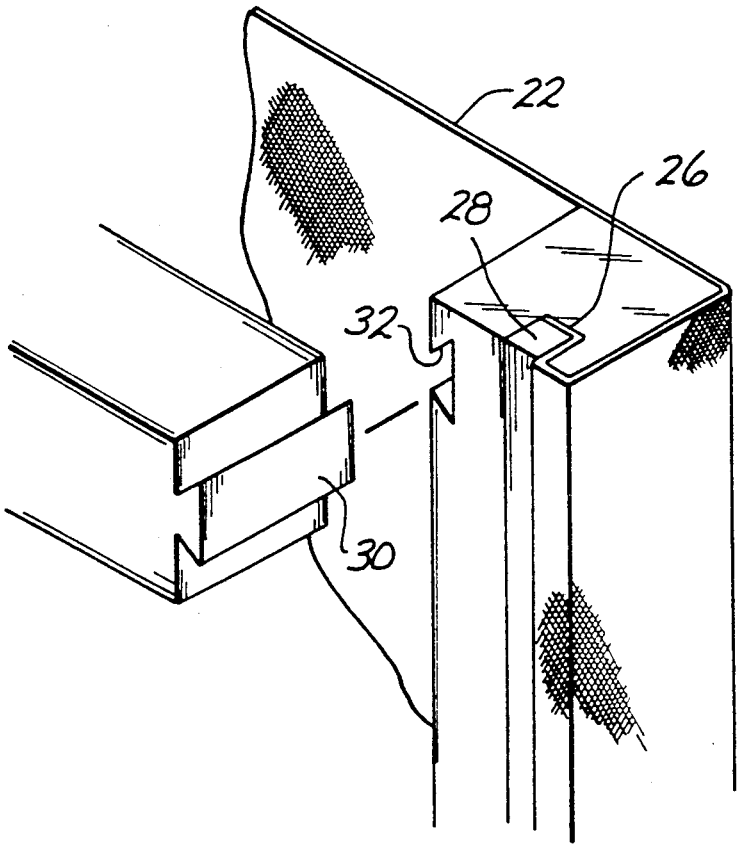
FIG. 5 is an enlarged perspective view of the joint between the frame support member and a frame spacer member.

Viewing FIGS. 2, 4, and 5, the preferred means for attaching the fabric panel 22 to each of the two frame support members 14, 16, which comprises a cord and groove arrangement, is shown. On the rear face of each of the frame support members a groove 26 is cut, which runs along the entire length of the member. One end of the fabric panel 22 is inserted into the groove 26, after which a cord-like member 28, such as a strip of rubber, is jammed into the groove atop the fabric panel end, such that the cord is tightly held within the groove in an interference fit relationship. With the fabric end thus held fast beneath the cord 28, the fabric is wrapped tightly around the frame support member 14, 16, across the front face of the frame support member, and then is stretched across the spacing between the two frame support members. Similarly, the fabric panel 22 is wrapped tightly around the other frame support member 14, 16 and the opposite fabric panel end is inserted into the corresponding groove 26. Again, another length of cord 28 is inserted into the groove 26 in an interference fit fashion, the result being that the two opposite ends of the fabric panel 22 are firmly attached to each of the two frame support members 14, 16. Of course, other known attachment means may be employed without exceeding the scope of the invention, such as staples or glue, such substitutions being within the purview of one or ordinary skill in the art. An important feature of the invention, however, is that the fabric panel 22 is attached only to the two frame support members 14, 16, and is not directly attached to the frame spacer members 18, 20. This feature permits the inventive display frame to be very portable and easy to transport.

Again viewing in particular FIG. 5, an enlargement of one of the joints between a frame support member 14, 16 and a frame spacer member 18, 20 is shown. The joint is preferably a dovetail joint, wherein tongue member 30 on the frame spacer member is inserted into groove 32 on the frame support member such that the fit is an interference fit. Of course, the tongue member can be on the frame support member and the groove on the frame spacer member. Such a joint is particularly useful for quickly attaching and detaching two elements, which allows the frame to thus be quickly assembled and disassembled, without the need for assembly/disassembly tools or expertise, for easy portability. It is within the scope of this invention to use other known easily attachable and detachable joints as well.

Figure 6:
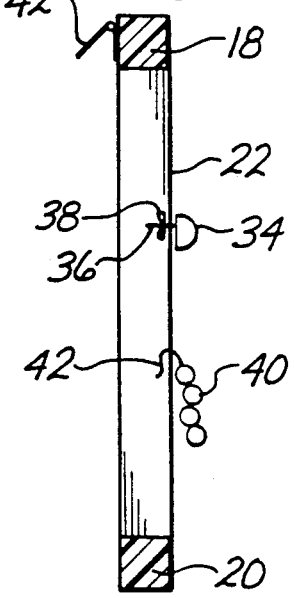
FIG. 6 is a cross-section view as seen along lines 6—6 of FIG. 4, showing two types of earrings inserted into the fabric panel.

FIG. 6 is a cross-sectional view along lines 6—6 in FIG. 4, which shows the fabric panel 22 with earrings 34 and 38 placed through it. Earring 34 is of the type having a straight pin-like shaft 36 which is designed for placement through a pierced ear, after which a back 38 is capped onto the end of the shaft 36 to hold the earring 34 in place. To use this invention the shaft 36 is placed through the fabric panel 22 after which the back 38 is capped onto the end of the shaft. Earring 40 is of the "French hook" type wherein hook 42 is placed through the fabric panel 22 and the earring is held in place by virtue of the bend in the hook. Of course, any other type of jewelry or for that matter any other object which has a pin-like shaft may be displayed or stored by the apparatus of this invention.

Referring to FIGS. 4 and 6, a mounting hinge 42 is shown. The hinge 42 is shown fixedly attached to frame spacer member 18 by means such as screws, but it could just as well be attached to any of the frame members. Using mounting hinge 42, the frame 12 may be mounted to a wall or stand, for example, by means of screws or the like which pass through holes 44 and into the wall or stand, in a manner well known in the art. The hinge allows the frame 12 to remain fixedly mounted while an earring back 38 is being placed or removed, because the frame can be swung away from the wall or stand by the hinge, allowing easy access to the back of the frame.

FIG. 3 shows apparatus 10 in its disassembled mode. To disassemble the frame 12, the frame spacer members 18, 20 are detached from the frame support members 14, 16 by removing the dovetail tongue members 30 from the grooves 32. Then, frame support members 14, 16 are rotated toward each other, scrolling the fabric panel 22 about each of the frame support members until frame support members 14, 16 are adjacent one another with little or no spacing between them. At this point, as shown in FIG. 3, the fabric panel 22 will be tightly scrolled about the frame support members, and the result is a very compact package for transporting the apparatus from one location to another, or for storing the device.

In use, the disassembled apparatus 10 is transported to the location desired for displaying or storing earrings or other jewelry. The disassembled apparatus 10 looks as depicted in FIG. 3, with perhaps a band or cord wrapped around the scrolled fabric panel 22 and the separate frame spacer members 18, 20 to create one compact unit for placement into a carrying case. When assembly is desired, tongue members 30 on frame spacer members 18, 20 are inserted into their corresponding grooves 32 at either end of each of the frame support members 14, 16. The spacer members 18, 20 are sized to cause the fabric panel 22 to be unscrolled to a desired level of tautness in order to fit the spacer members between the support members 14, 16. Assembly is completed when the spacer members 18, 20 are inserted, creating a tightly fitted four-sided frame for mounting on a wall or stand by means of hinge 42. When disassembly is desired, the frame spacer members 18, 20 are removed from the frame support members 14, 16 and the fabric panel 22 is scrolled about the frame support members, as earlier described. Whether assembled or disassembled, the fabric panel 22 always remains attached to frame support members 14, 16. The fact that the fabric panel 22 is not attached to frame spacer members 18, 20 is a feature which enhances the easy assembly/disassembly of the apparatus since the fabric need not be detached and reattached to the frame spacer members every time the frame 12 is disassembled and assembled.

Although an exemplary embodiment of the invention has been shown and described, many changes, modifications, and substitutions may be made by one having ordinary skill in the art without necessarily departing from the spirit and scope of the invention.

What is claimed is:

1. An apparatus for displaying or storing objects having at least one pin-like shaft comprising:

fabric means through which said pin-like shafts of said objects are placed;

a first frame support means, a first end of said fabric means being attached to said first frame support means;

a second frame support means, a second end of said fabric means being attached to said second frame support means; and at least one frame spacer means, said frame spacer means being positioned between said first frame support means and said second frame support means to maintain a spaced relationship therebetween, said fabric means not being directly attached to said frame spacer means.

2. The apparatus as recited in claim 1, wherein a first end of said frame spacer means is attached to said first frame support means and a second end of said frame spacer means is attached to said second frame support means.

3. The apparatus as recited in claim 2, said frame spacer means having a tongue or groove on each of said first and second ends, each tongue or groove being adapted to engage a corresponding groove or tongue on each of said first and second frame support means, said engagement being an interference fit.

4. The apparatus as recited in claim 3, wherein said frame spacer means has a tongue on each of said first and second ends.

5. The apparatus as recited in claim 1, wherein a first frame spacer means is positioned between a first end of said first frame support means and a first end of said second frame support means and a second frame spacer means is positioned between a second end of said first frame support means and a second end of said second frame support means such that said first and second frame support members and said first and second frame spacer members together form a generally rectangular frame.

6. The apparatus as recited in claim 1, wherein said fabric means includes ornamental decorations, and said objects comprise jewelry which may be arranged to complement said decorations to create an aesthetically pleasing display medium for said jewelry.

7. The apparatus as recited in claim 1, wherein said objects comprise at least one earring having a pin-like shaft which is placed through said fabric means and further having a back which is adapted to cap the end of said shaft after it has been placed through said fabric means, said back further securing said earring to said fabric means.

8. The apparatus as recited in claim 1, further comprising a hinge means for mounting said apparatus to a wall or stand, said hinge means being positioned on one of said frame support or spacer members and allowing the apparatus to swing out from said wall or stand while mounted so that said fabric means is readily accessible for placing said objects into or removing said objects from said fabric means.

9. The apparatus as recited in claim 1, wherein each of said first and second frame support means has a front surface and a back surface, and said apparatus further comprising a fabric attachment means for attaching said first and second ends of said fabric means to each of said first and second frame support means, said fabric attachment means comprising:

a groove running along the back surface of each of said first and second frame support means;

said fabric means stretching between said first and second frame support means, over the front surface of each, and being wrapped around each; and a plurality of cord-like means each of which is adapted for fitting into one of said grooves, each said cord-like means having a width sufficient that the fit into said groove is an interference fit serving to hold the respective end of said fabric means in its respective groove.

10. An apparatus for displaying or storing objects having at least one pin-like shaft comprising:

fabric means through which said pin-like shafts of said objects are placed;

a first frame support means, a first end of said fabric means being attached to said first frame support means;

a second frame support means, a second end of said fabric means being attached to said second frame support means;

at least one frame spacer means, said frame spacer means being positioned between said first frame support means and said second frame support means to maintain a spaced relationship therebetween, said frame spacer means and each of said first and second frame support means forming a frame over which said fabric means is stretched; and said frame spacer means being adapted to be easily and quickly attached to and detached from each said frame support means such that said frame can be readily assembled and disassembled for easy portability.

11. The apparatus as recited in claim 10, wherein when said frame spacer means is detached from said first and second frame support means, each of said first and second frame support means can be rotated toward each other until there is substantially no space between said first and second frame support means, said fabric means being wrapped around each of said first and second frame support means in scroll like fashion as they are rotated, such that the apparatus can be made compact for portability without detaching said fabric means from said first and second frame support means.

12. The apparatus as recited in claim 10, wherein said fabric means is not directly attached to said frame spacer means.

13. The apparatus as recited in claim 10 wherein a first end of said frame spacer means is attached to said first frame support means and a second end of said frame spacer means is attached to said second frame support means.

14. The apparatus as recited in claim 13, said frame spacer means having a tongue or groove on each of said first and second ends, each tongue or groove being adapted to engage a corresponding groove or tongue on each said first and second frame support means, said engagement being an interference fit.

15. The apparatus as recited in claim 13, wherein said frame spacer means has a tongue on each of said first and second ends.

16. The apparatus as recited in claim 10, wherein a first frame spacer means is positioned between a first end of said first frame support means and a first end of said second frame support means and a second frame spacer means is positioned between a second end of said first frame support means and a second end of said second frame support means such that said first and second frame support members and said first and second frame spacer members together form a generally rectangular frame.

17. The apparatus as recited in claim 10, wherein said fabric means includes ornamental decorations, and said objects comprise jewelry which may be arranged to complement said decorations to create an aesthetically pleasing display medium for said jewelry.

18. The apparatus as recited in claim 10, wherein said objects comprise at least one earring having a pin-like shaft which is placed through said fabric means, and further having a back which is adapted to cap the end of said shaft after it has been placed through said fabric means, said back further securing said earring to said fabric means.

19. The apparatus as recited in claim 10, further comprising a hinge means for mounting said apparatus to a wall or stand, said hinge means being positioned on one of said frame support or spacer members and allowing the apparatus to swing out from said wall or stand while mounted so that said fabric means is readily accessible for placing said objects into or removing said objects from said fabric means.

20. The apparatus as recited in claim 10, wherein each of said first and second frame support means has a front surface and a back surface, and said apparatus further comprising a fabric attachment means for attaching said first and second ends of said fabric means to each of said first and second frame support means, said fabric attachment means comprising:

a groove running along the back surface of each of said first and second frame support means;

said fabric means stretching between said first and second frame support means, over the front surface of each, and being wrapped around each; and a plurality of cord-like means, each of which is adapted for fitting into one of said grooves, each said cord-like means having a width sufficient that the fit into said groove is an interference fit serving to hold the respective end of said fabric means in its respective groove.

* * * * *